US008180245B2

(12) United States Patent
Dergham et al.

(10) Patent No.: US 8,180,245 B2
(45) Date of Patent: May 15, 2012

(54) XEROGRAPHIC MACHINE TONER CONTAMINATION CONTROL SYSTEM

(75) Inventors: Ali R Dergham, Fairport, NY (US); Francesco Zirilli, Penfield, NY (US); Glenn Bennett, Rochester, NY (US); Jorge Rodriguez, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 636 days.

(21) Appl. No.: 12/369,419

(22) Filed: Feb. 11, 2009

(65) Prior Publication Data

US 2010/0202795 A1 Aug. 12, 2010

(51) Int. Cl.
*G03G 21/00* (2006.01)

(52) U.S. Cl. ..... 399/93; 399/99

(58) Field of Classification Search ..... 399/98, 399/92, 93, 99

See application file for complete search history.

(56) References Cited

U.S. PATENT DOCUMENTS

| | | | | |
|---|---|---|---|---|
| 4,540,268 | A * | 9/1985 | Toyono et al. | 399/93 |
| 5,087,943 | A * | 2/1992 | Creveling | 399/93 |
| 5,138,375 | A * | 8/1992 | Iimori | 399/92 |
| 5,142,328 | A * | 8/1992 | Yoshida | 399/93 |
| 5,899,600 | A * | 5/1999 | Hockey et al. | 399/93 |
| 6,334,033 | B1 * | 12/2001 | Ayash et al. | 399/98 |
| 6,463,230 | B1 * | 10/2002 | Wargo | 399/92 |
| 6,522,847 | B2 * | 2/2003 | Nanjo | 399/92 |
| 6,621,990 | B1 * | 9/2003 | Beehler et al. | |
| 6,711,959 | B2 * | 3/2004 | Rejewski | |
| 2005/0180772 | A1 * | 8/2005 | Dergham et al. | 399/92 |

FOREIGN PATENT DOCUMENTS

JP 2003103129 A * 4/2003

* cited by examiner

*Primary Examiner* — Susan Lee

(74) *Attorney, Agent, or Firm* — Ronald E. Prass, Jr.; Prass LLP

(57) ABSTRACT

This is a toner control system for use in a cleaning station of a xerographic marking apparatus. A sensor is located in the air conduits of the system to measure airflow throughout the system. The sensor is in contact with a controller that is configured to adjust the blower speed to normal conditions (i.e. sea level and clean filter conditions) as the flow rate is reduced due to normal apparatus use. The system has an air blower(s), a filter(s), air conduits, a sensor(s) and a controller (s) in communication with the sensor(s).

12 Claims, 3 Drawing Sheets

XEROGRAPHIC MACHINE TONER CONTAMINATION CONTROL SYSTEM

FIELD

This invention relates to a xerographic marking system and, more specifically, to a structure and system for removing airborne toner contaminants from the cleaning station or developer housing of said marking systems.

BACKGROUND

By way of background in the process of electrostatographic reproduction, a light image of an original to be copied or printed is typically recorded in the form of a latent electrostatic image upon a photosensitive member with a subsequent rendering of the latent image visible by the application of electroscopic marking particles commonly referred to as toner. The visual toner image can be either fixed directly upon the photosensitive member or transferred from the member to another support medium such as a sheet of plain paper. To render this toner image permanent, the image must be "fixed" or "fused" to the paper, generally by the application of heat and pressure.

With the advent of high speed monochrome and color marking machines, including xerography reproduction machines wherein copiers or printers can produce at a rate in excess of three thousand copies per hour, the need for an improved cleaning system designed to collect airborne toner from the developer housing or station is evident.

Many xerographic copiers and duplicators use a waste system designed to collect waste toner from the developer housings and the cleaner. Other important functions of the contamination control system include, transport, separation, collecting and filtering of the air before it is returned to an environmental unit, or in many cases the customer environment. Another function of the contamination control system is the collection, transport, and processing of ozone generated by the corona devices. The flow requirements of the each of these systems are such that a variety of blowers are needed to provide the required air flow. There are two ways that system performance may be degraded. First is the increased resistance in the systems due to the filling of the filters, and operation at different altitudes.

During normal operation, either at sea level or altitude, the performance of the contamination control system will degrade over time due to the increased filter resistance. It is required in many cases in the prior art to overdesign the system so that performance is maintained after a specified number of prints between maintenance cycles. This practice produces, in many cases, excessive noise from the blowers, and excessive toner waste from the developer housings. This invention proposes the use of a blower control circuit, a temperature sensor, and a mass flow rate sensor to adjust the blower speed as the flow is reduced due to normal machine use.

SUMMARY

In some prior art contamination control systems, each of the blowers is preceded by a filter, whose main function is to prevent toner contamination to enter the blowers and escape into the customer environment. Each blower is chosen such that under full filter conditions the main function of each of the sub-systems is maintained. This requires that the set blower speed with the clean filter condition be overdesigned by as much as 30%. This difference in the blower speed may be the difference between an acceptable or unacceptable noise levels for the entire machine.

Use of speed control system for the blowers used in the contamination control system allows the design to be evaluated at the true worst conditions such as full filter conditions and altitude operation. Once the blower speeds have been set for the worst condition, then they can be adjusted down for clean filter conditions and sea level operation. It was shown that at this operating point, the cleaner and development sub-system still have plenty of operational latitude. However, the operator is instructed to replace the filter since the minimum operating pressure of the system is achieved.

In the prior art system, operating at clean filter conditions, both the cleaner and the developer housings are operating above the required flow rate. That is, the system is overdesigned.

With today's computational capabilities it is convenient to develop computational models to predict the system performance at any desired blower speed and operating point. Therefore, it is possible to numerically develop the relationships required to correlate the sub-system pressures (such as cleaner and development) with the system pressure, blower speed and filter resistance. These correlations can then be used as a lookup table in the machine control system to adjust the blower speed as the system resistance changes. As the filter resistance increases for a given blower speed w, the flow operating point of the system decreases as the filter pressure drop increases. It is plausible to control the total flow $Q_n$ by continuously increasing the blower speed. In the present invention, this algorithm will improve the system performance in several ways: increase the filter life, reduce noise at t=0, improve performance at altitude, reduce variation in the individual subsystem flow rates due to tolerances, and reduce service cost.

The present invention provides a toner waste control system that avoids the need to overdesign by setting the flow rate of the system above the required flow rate. Provided by this invention is an algorithm that develops the relationship required to correlate the sub-system pressures (such as cleaner and development) with the system pressure, blower speed and filter resistance. As the filters become contaminated because of extended use, the air flow and pressure in the system is reduced. As noted, it is possible to numerically develop the relationship required to correlate the subsystems pressures with the filter resistance and to adjust the blower speed as the system resistance changes.

A mass flow rate sensor or sensors are used to measure mass flow, convey this information to a controller which will adjust the blower speed as the flow is reduced due to normal machine use. Once the blower speeds for worse conditions are known then they can be adjusted down for clean filter conditions and sea level operation. These correlations can then be used in a lookup table or model to adjust the blower speed as the system resistance changes.

The present system can be used in any electrophotographic marking system which requires a toner contamination control system. Obviously a new or different model will be needed for each family of machines. Once the clean filter conditions, sea level conditions, and blower speeds are known, a model can be established for adjusting subsequent changing filter and altitude conditions, so that normal operating parameters are maintained throughout each run in spite of the change in elevation and filter resistance. By "normal conditions" is meant throughout this disclosure and claims to mean sea level elevations and clean filter conditions. An aim of this invention is to maintain normal conditions throughout the life of the apparatus irrespective of filter contamination and elevation of the machine location.

A typical sensor(s) used in the present invention is model no. 840200 made or obtained from TSI Incorporated, for example. The sensors are needed with the controller to adjust the blower speed as the flow is reduced due to normal machine use and filter contamination. At least one sensor is used; however, if conditions require several, desirably positioned sensors may be used throughout the system. A typical controller used may be digital or analog. One such controller is the Sensirion SFC400, for example. Obviously each controller must contain the necessary software suitable for the present system.

DETAILED DISCUSSION OF DRAWINGS AND PREFERRED EMBODIMENTS

Figure 1:
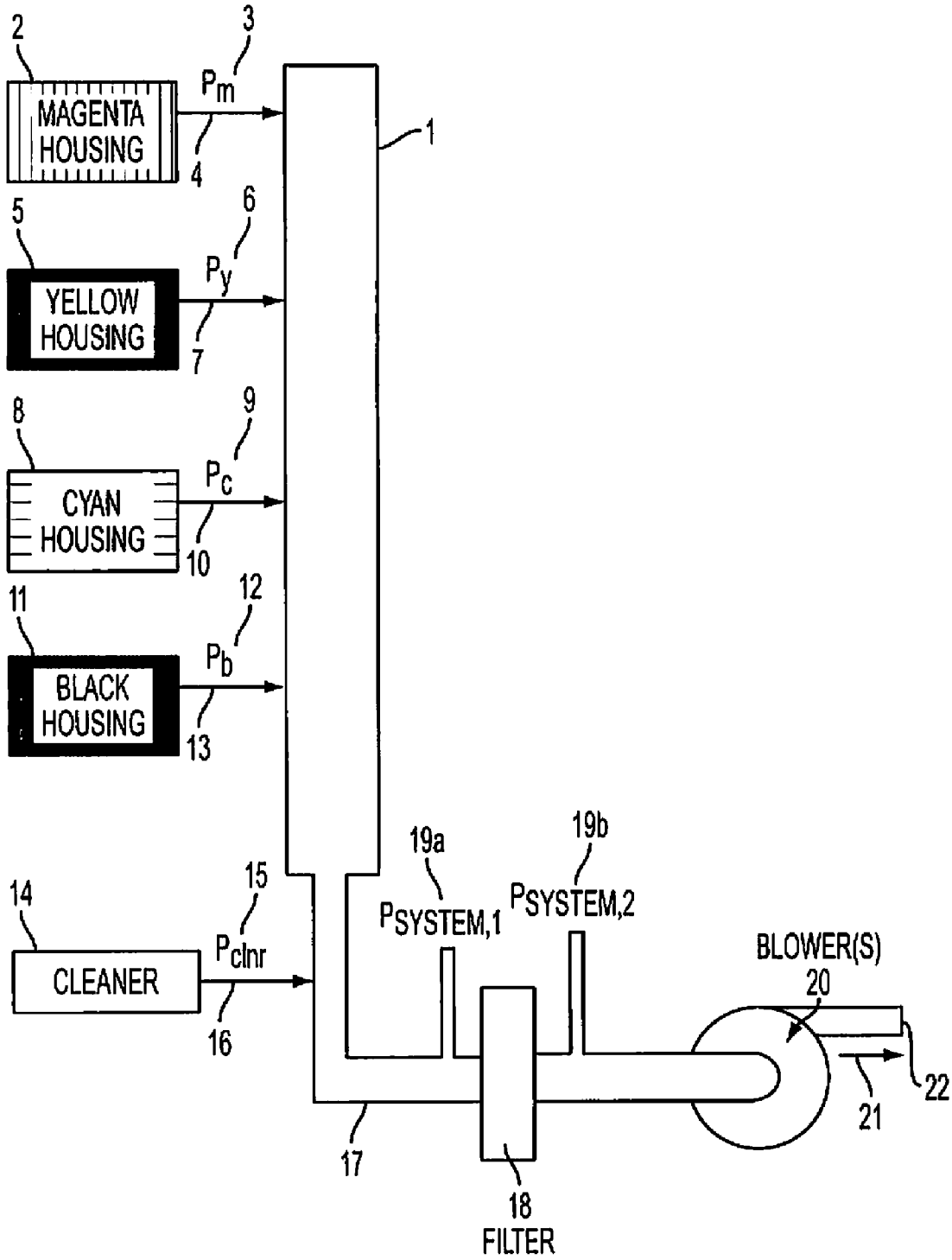
FIG. 1 PRIOR ART
FIG. 1 illustrates a typical prior art four color marking system using a xerographic process.

FIG. 1 shows the prior art design of a typical four color printer using the xerographic process. In general, the four developer housings: magenta (2), yellow (5), cyan (8), and black (11) are connected to a main manifold (1) which is supplied with a vacuum flow in the direction (21) provided by a single blower (20). Multiple blowers (20) may be required to achieve the desired flow depending on the system design. The exhaust flow (22) is usually recirculated through the system or exhausted into the atmosphere. The filter (18) is used to filter the toner laden air from the developer housings (2,5,8,11). The filter (18) is sometimes used with a cyclone separator system (not shown) to increase the filter life. In many applications an additional sub-system such as the cleaner (14) is connected to the manifold (1) via a hose (17). The cleaner vacuum flow is in the direction (16). The total flow requirements are determined by the performance requirements of the developer housings (2,5,8,11), and the cleaner (14). The blower (20) needs to provide enough flow to achieve a pre-determined operating pressure for each of the developer housing (2,5,8,11), and the cleaner (14). These pressures are measured on the developer housing side as shown in FIG. 1 for the magenta housing (2) the corresponding pressure (3), for the yellow housing (5) the corresponding pressure (6), for the cyan housing (8) the corresponding pressure (9), for the black housing (11) the corresponding pressure (12), and finally for the cleaner (14) the corresponding pressure (15).

It is expected that the performance of the system does not degrade in performance as it is operated from sea level to 9000 ft altitude. As the elevation increases, the mass flow rate of the system decreases and as a result so do the required operating pressures. This reduction in operating pressure reduces the filter life which is determined by the pressure difference across the filter (18) given by the difference in pressures (19*b* and 19*a*). In order to maintain performance at altitude, the system is designed to operate at ~30% more capacity at sea level. This provides the required pressures and flow as the altitude increases to 9000 ft. This design practice leads to a system over-design which:

A. increases noise levels due to higher blower (20) speeds

B. increases power consumption

C. increases system operating temperatures

D. decreases components life (such as blowers, and electronics)

E. increases overall cost of ownership

Figure 2:
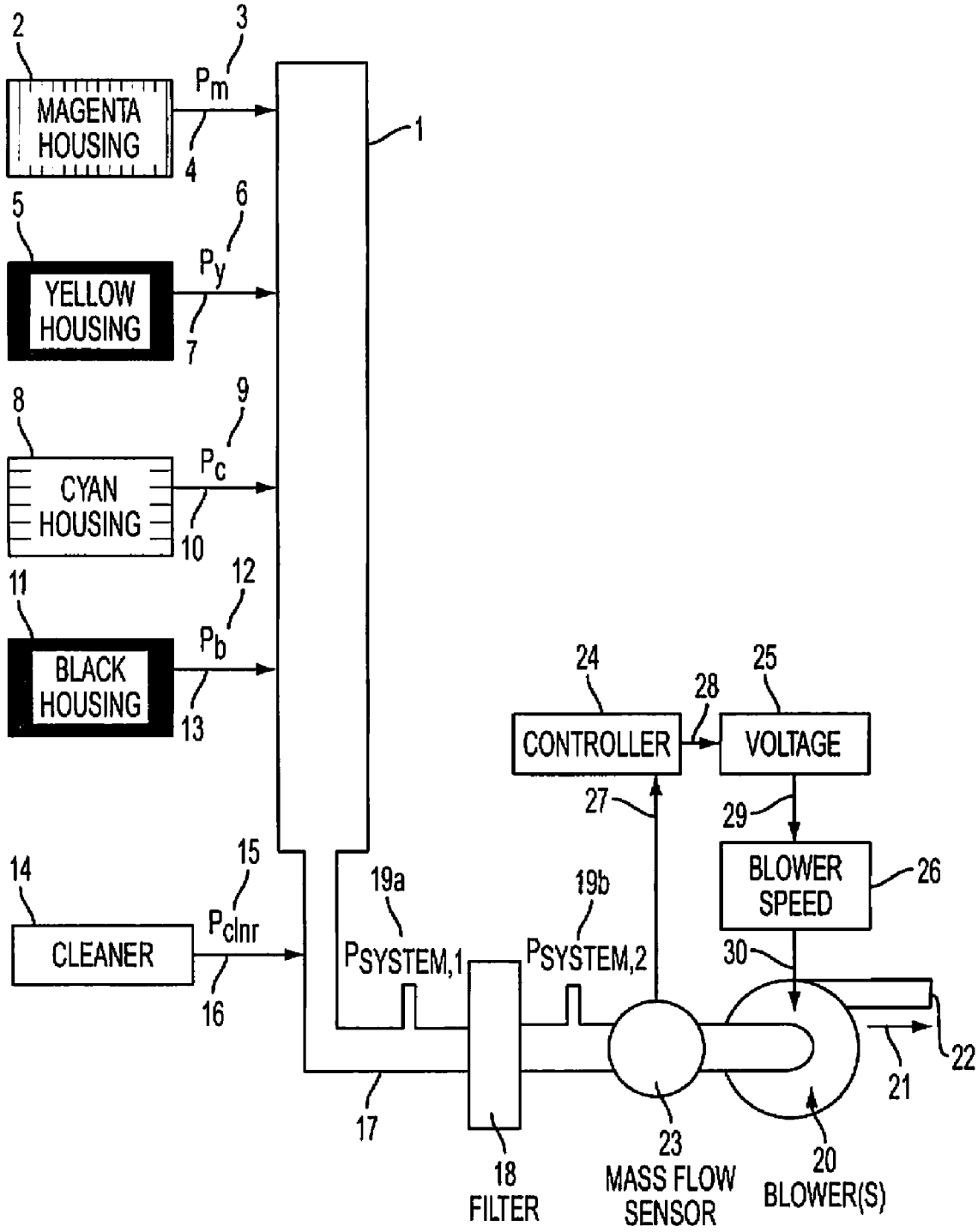
FIG. 2 illustrates an embodiment of the present invention where the optimal mass flow rate of the system is utilized.

The system of this invention (one embodiment) which is shown in FIG. 2 includes a mass flow rate sensor (23) that measures the mass flow rate in manifold (1), connecting hose (17), and filter (18) which is delivered by blowers(s) (20). The mass flow rate sensor (23) is connected to a controller (24) via connector (27). The controller (24) determines the required blower voltage to maintain a pre-determined flow rate by using a look-up table, or a known empirical relationship between output voltage and mass flow rate. The controller (24) provides an output voltage (25) via connection (28). The voltage (24) is also converted into a required blower speed (26) via connection (29) using a look-up table or a known empirical relationship between applied voltage (25) and blower speed (26). The required blower speed (26) is supplied to blower(s) (20) via connection (30).

The optimal mass flow rate of the system is determined during the design process. This mass flow rate is in turn determined by the requirements of the developer housing flows (2,5,8,11), and, in this particular example, the cleaner sub-system (14). Normally, this flow rate is determined under worse case environmental conditions. The environmental condition that has the largest impact on the mass flow rate is altitude above sea level. In general the system is required to operate from sea level to 9000 ft. A system which is required to operate at sea level requires 30% less mass flow than at 9000 ft. The proposed design automatically adjusts the mass flow rate of the system based on the operating altitude. As a result, when operating at sea level, a 30% reduction in the flow rate would translate into lower noise level, lower power consumption, lower system operating temperature, and lower cost of ownership.

Figure 3:
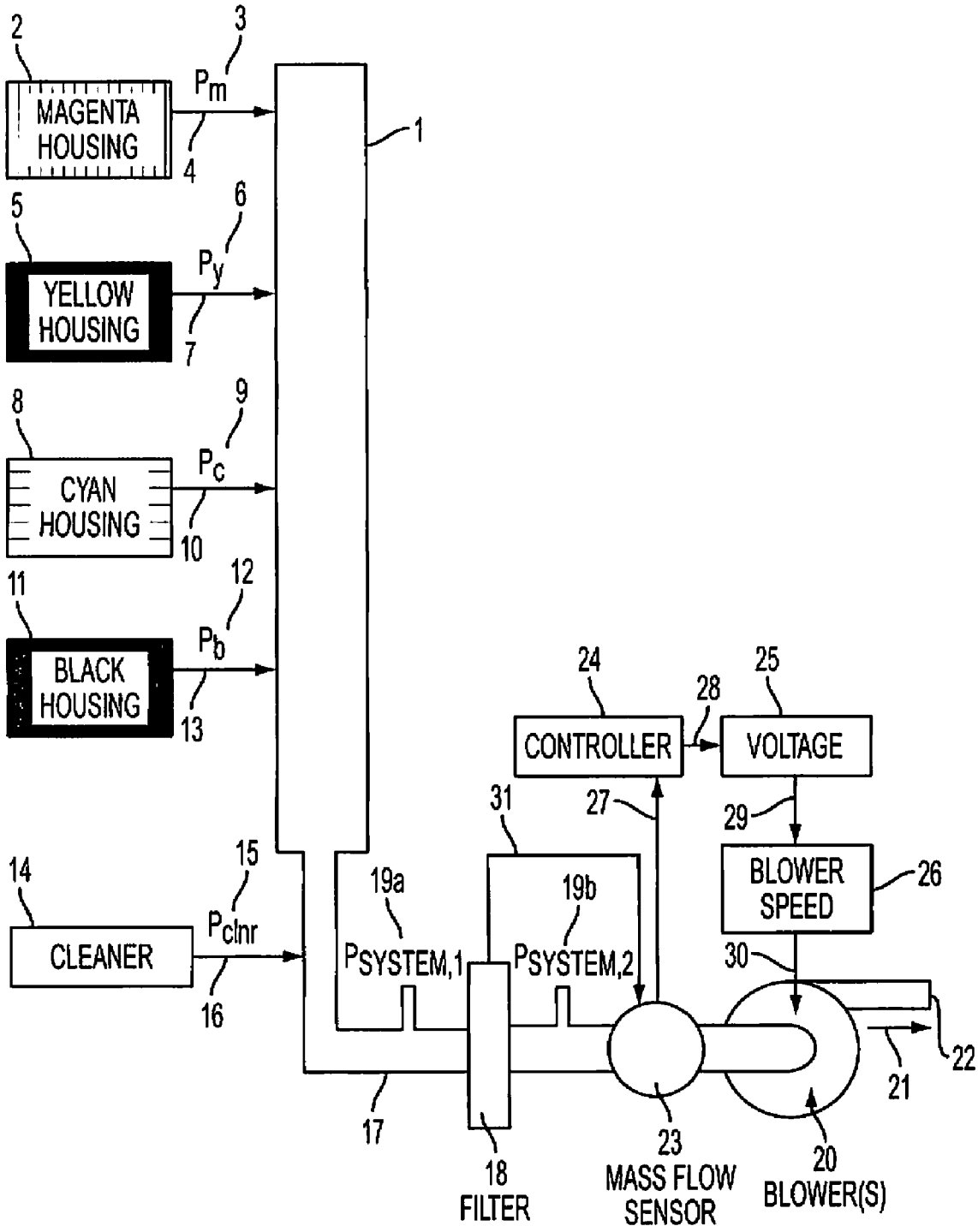
FIG. 3 illustrates another embodiment of the present invention where the filter life of the system is significantly increased.

In FIG. 3, another advantage of using a mass flow rate sensor to control the total system flow rate is the ability to increase filter life. Since ~90% of the machines installed operate at less than ~5500 ft, the mass flow rate sensor operation described above may be used to adjust the system flow rate as the filter efficiency decreases due to normal operation. The pressure drop information is sent to the mass flow rate sensor (23) via connection (31). A look up table is used to compare the desired flow rate to the actual and make the blower speed adjustment as described before.

In summary, this invention comprises a toner contamination control system for use in a cleaning station of a xerographic marking apparatus. This system comprises at least one air blower, at least one filter, air flow conduits, at least one airflow sensor located in the conduits, and a controller in operational connection to the sensor. The sensor is configured to measure mass air flow rate through the conduits and entire system. The controller comprises algorithms including the relationship between filter resistance, flow rate and blower speed conditions; is configured to record the conditions and adjust the blower speed to normal conditions as the flow rate is reduced due to normal apparatus use. Each blower is preceded by at least one filter. The air blowers are selected from the group consisting of waste blowers, ozone blowers, Hot Air Knife (HAK) blowers, heat blowers and mixtures thereof Each filter is configured to prevent other contamination to enter the blowers and escape to a customer's environment. The blower is configured to exit air to an environmental unit and to exit ozone from the cleaning station.

The system is also configured to reduce operational noise levels for the apparatus. The airflow sensor and the controller are configured to correct for altitude and air flow variations in the system.

This toner contamination control system is for use in a cleaning station of a xerographic marking apparatus. The system comprises a developer housing, at least one air blower, at least one filter, air flow conduits, at least one airflow sensor, some located in the conduits, and a controller in operational connection to the sensor. The control system is configured to collect and dispose of airborne toner from the developer housing.

The controller comprises software configured to numerically develop a relationship required to correlate desired normal system pressures with existing system pressure, blower speed and filter resistance.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A toner contamination control system for use in a cleaning station of a xerographic marking apparatus, said system comprising:

at least one air blower, at least one filter, air flow conduits, at least one airflow sensor located in said conduits, and a controller in operational connection to said sensor, said sensor configured to measure mass air flow rate through said conduits, said controller comprising algorithms on the relationship between filter resistance, flow rate and blower speed conditions and configured to record said conditions and adjust said blower speed to normal conditions as said flow rate is reduced due to normal apparatus use, wherein said controller numerically develops a relationship required to correlate desired normal system pressures with existing system pressure, blower speed and filter resistance.

2. The system of claim 1 wherein each said blower is preceded by at least one said filter.

3. The system of claim 1 wherein said air blowers are selected from the group consisting of waste blowers, ozone blowers, Hot Air Knife (HAK) and heat blowers.

4. The system of claim 1 wherein said blower is configured to exit ozone from said cleaning station.

5. The system of claim 1 which is configured to reduce operational noise levels for said apparatus.

6. The system of claim 1 wherein said airflow sensor and said controller are configured to correct for altitude and air flow variations in said system.

7. A toner contamination control system for use in a cleaning station of a xerographic marking apparatus, said system comprising:

a developer housing, at least one air blower, at least one filter, air flow conduits, at least one airflow sensor located in said conduits, and a controller in operational connection to said sensor, said sensor configured to measure mass air flow rate through said conduits, said controller comprising algorithms on the relationship between filter resistance, flow rate and blower speed conditions and configured to record said conditions and adjust said blower speed to normal conditions as said flow rate is reduced due to filter contaminations and normal apparatus use, said control system configured to collect and dispose of airborne toner from said developer housing, wherein said controller numerically develops a relationship required to correlate desired normal system pressures with existing system pressure, blower speed and filter resistance.

8. The system of claim 7 wherein each said blower is preceded in said system by at least one said filter.

9. The system of claim 7 wherein said air blowers are selected from the group consisting of waste blowers, ozone blowers, Hot Air Knife (HAK) blowers and heat blowers.

10. The system of claim 7 wherein said blower is configured to exit ozone from said cleaning station and said developer housing.

11. The system of claim 7 which is configured to reduce operational noise levels for said apparatus.

12. The system of claim 7 wherein said airflow sensor and said controller are configured to correct for altitude and air flow variations in said system and convert to normal conditions in said system.

* * * * *